US005868186A

United States Patent [19]

Mulligan et al.

[11] Patent Number: 5,868,186

[45] Date of Patent: Feb. 9, 1999

[54] DEBARKING WOOD WITHOUT INTRODUCING CONTAMINANTS INTO THE WOOD

[75] Inventors: David Dwight Mulligan; John Rolfe Hite Martin, both of Covington, Va.

[73] Assignee: Westvaco Corporation, New York, N.Y.

[21] Appl. No.: 927,587

[22] Filed: Sep. 11, 1997

[51] Int. Cl.[6] ..... B27L 1/00

[52] U.S. Cl. ..... 144/341; 144/208.1; 144/208.9; 144/342; 241/103

[58] Field of Search ..... 241/183, DIG. 30, 241/14, 20; 144/208.1, 208.5, 208.9, 340, 341, 342

[56] References Cited

U.S. PATENT DOCUMENTS

| | | | |
|---|---|---|---|
| 3,286,747 | 11/1966 | Delcellier . | |
| 3,299,919 | 1/1967 | Saresvuo . | |
| 3,746,063 | 7/1973 | Smiltneek . | |
| 3,826,433 | 7/1974 | Erickson et al. | 241/14 |
| 3,955,608 | 5/1976 | Smiltneek . | |
| 3,963,064 | 6/1976 | Hayes . | |
| 4,036,440 | 7/1977 | Makila et al. | 241/20 |
| 4,043,901 | 8/1977 | Gauld . | |
| 4,140,281 | 2/1979 | Fulghum, Jr. et al. . | |
| 4,173,239 | 11/1979 | Reiche . | |
| 4,226,271 | 10/1980 | Coleman | 144/208.9 |
| 4,293,014 | 10/1981 | Lundmark | 144/208.9 |
| 4,332,353 | 6/1982 | Lario et al. . | |
| 4,369,823 | 1/1983 | Gustafsson | 144/340 |
| 4,445,558 | 5/1984 | Banner et al. | 144/341 |
| 4,774,987 | 10/1988 | Sepling . | |
| 5,005,621 | 4/1991 | Woodham . | |
| 5,019,123 | 5/1991 | Clarke-Pounder et al. . | |
| 5,044,412 | 9/1991 | Price et al. . | |
| 5,097,880 | 3/1992 | Pousette . | |
| 5,247,978 | 9/1993 | Silenius et al. . | |
| 5,349,999 | 9/1994 | Peterson et al. . | |
| 5,394,912 | 3/1995 | Hume . | |
| 5,458,172 | 10/1995 | Rautio . | |
| 5,474,186 | 12/1995 | Fulghum, Jr. et al. . | |

FOREIGN PATENT DOCUMENTS

| | | |
|---|---|---|
| 1150552 | 7/1983 | Canada . |

OTHER PUBLICATIONS

Pentti Hakkila et al; Production, Harvesting and Utilization of Small–sized Trees; Helsinki 1979; pp. 108–112.

Procédé industriel de Nettoyage des copeaux Vents; Oct. 1979 pp. 50–51 with 5 page attachment.

*Primary Examiner*—W. Donald Bray

*Attorney, Agent, or Firm*—J. R. McDaniel; R. L. Schmalz

[57] ABSTRACT

This invention relates to a wood chip recovery system which removes bark from roundwood or wood chips. It is desirable for such structures of this type to recover the wood chips from the bark without introducing contaminants, such as metal ions like iron, into the debarked roundwood or wood chips.

13 Claims, 1 Drawing Sheet

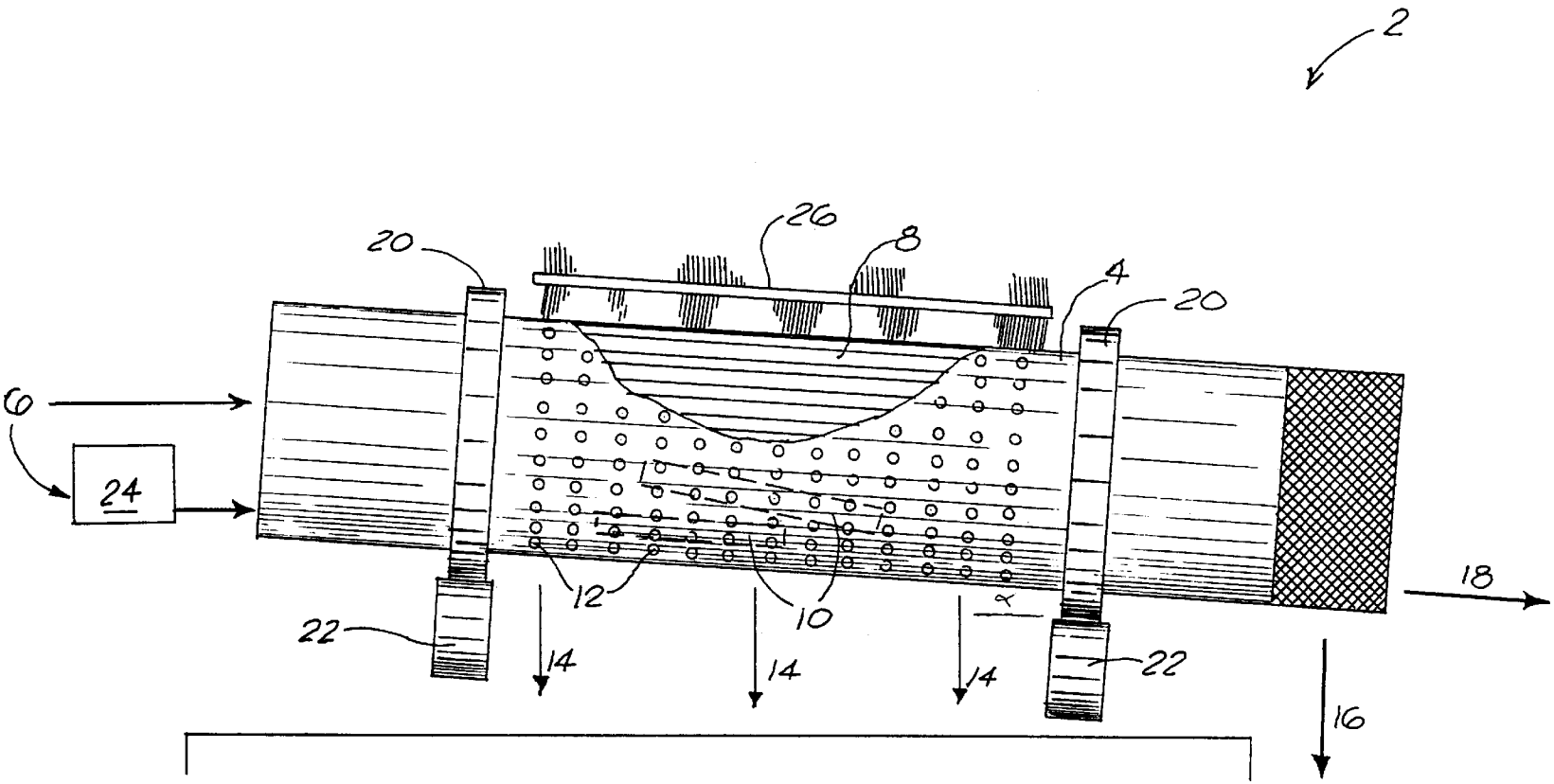
FIGURE

DEBARKING WOOD WITHOUT INTRODUCING CONTAMINANTS INTO THE WOOD

BACKGROUND OF THE INVENTION

1. Field of the Invention

This invention relates to a wood chip recovery system which removes bark from roundwood or wood chips. It is desirable for such structures of this type to recover the wood chips from the bark without introducing contaminants, such as metal ions like iron, into the debarked roundwood or wood chips.

2. Description of the Related Art

Availability of wood from the forest is declining because of an increase in demand from new users and due to added limitations on harvesting. These factors make it imperative that ways are identified to improve wood recovery in order to ensure a sufficient, future and economical wood supply.

Harvesting trees as whole-tree chips, or WTC, is a commercial approach proven to increase wood recovery. WTC processing increases wood recovery by around twenty-five percent beyond recovery of commercial-grown wood, which recovery does not include branches and tree-top wood chip material. However, the high bark content of WTC, which can approach twenty percent, has been an impediment to submitting to a WTC utilization in applications like wood pulping and paper making.

High bark content in chips is undesirable because bark carries non-process elements (NPE) like metal ions that are detrimental to the paper pulp processing by reducing pulp yield and bleaching effectiveness while increasing scaling of heated process surfaces and corrosion. Sand from bark also accelerates erosion of valves, like those in pulp digesters, piping and elbows.

It is known, in wood chip debarking systems, to employ the use of ball-milling which acts as an abrasion means to remove the bark from the logs or chips of logs. Exemplary of such prior art bark removal systems is U.S. Pat. No. 4,332,353 ('353) to H. L. Lario et al. entitled "Procedure For Mechanically Raising Wood Content In Wood Chips". While the '353 reference discloses the removal of bark and green stuff matter from the wood chips by grinding, the grinding is accomplished through the use of ball-milling.

It is well known that using an iron attrition means, such as ball-milling, introduces iron by particles, dust, and/or discrete spalled pieces from ball/ball and ball/drum impacts. As a result of both bark grinding and metal particles, the ball-milling can therefore yield black chips difficult to purify. Also, the metal from the ball-milling can participate in sensitive chemical reactions in paper pulping, bleaching, recovery and fuel burning systems, and add high metal ions which are undesirable in most paper products.

It is apparent from the above that there exists a need in the art for a roundwood or wood chip system which is capable of debarking the logs or chips, but which at the same time avoids the introduction of the contaminants like NPE into the debarked wood chips. It is the purpose of this invention to fulfill this and other needs in the art in a manner more apparent to the skilled artisan once given the following disclosure.

SUMMARY OF THE INVENTION

This invention fulfills these needs by providing an apparatus for wood debarking comprising a substantially cylindrical debarking drum having an inside and an outside and a barky wood inlet means, a debarked wood outlet means and a length, wherein the drum is inclined at a predetermined angle such that the inlet means is raised above the outlet means, a barky wood agitating means located along the length and the inside of the drum, a debarked wood screening means located along the length and substantially between the inside and outside of the drum, a non-metallic attrition means located within the drum, and a drum rotating means operatively connected to the outside of the drum.

In certain preferred embodiments, the barky wood agitating means is comprised of a corrugated liner or L-shaped lifters located inside of the drum. Also, the non-metallic attrition means are further comprised of debarked logs, veneer cores or the like. Finally, the drum rotating means is further comprised of riding rings and trunnions.

In another further preferred embodiment, substantially all of the bark is removed from the wood through the use of the non-metallic attrition means so as to not add contaminants to the wood, such as NPE like metal particles and ions.

The preferred wood debarking system, according to this invention, offers the following advantages: good mechanical stability, high strength for safety, excellent debarking, excellent contaminant reduction, and excellent economy. In fact, in many of the preferred embodiments, these factors of debarking, reduced contaminants and economy are optimized to an extent that is considerably higher than heretofore achieved in prior, known wood debarking systems.

The above and other features of the present invention, which become more apparent as the description proceeds, are best understood by considering the following detailed description in conjunction with the accompanying FIGURE and in which:

BRIEF DESCRIPTION OF THE DRAWING

The FIGURE is a schematic illustration of an apparatus for wood debarking, according to the present invention.

DETAILED DESCRIPTION OF THE INVENTION

With reference to the FIGURE, there is illustrated apparatus 2 for wood debarking. Apparatus 2 includes, in part, drum 4, wood or wood chips 6, agitating interior 8, non-metallic attrition means 10, holes 12, debris 14, debarked wood discharges 16 and 18, conventional riding rings 20, conventional trunnions 22, conventional chip conditioner 24, and conventional deblinder brush 26.

In particular, drum 4 is constructed of any suitable rigid metallic material. Agitating area 8 is constructed within drum 4 through the use of any suitable corrugated metallic-like material or metallic L-shaped lifters, where it is to be understood that area 8 runs parallel to the length of drum 4. Attrition means 10, preferably, is constructed of previously debarked logs, veneer cores or the like to selectively degrade bark without introducing contaminants into the debarked roundwood or wood chips 6. Holes 12 are conventionally constructed in drum 4 so that they extend the entire thickness of drum 4. However, it is to be understood that the size of holes 12 is such that primarily dirt, sand, grit, bark and other debris 14 are able to escape through holes 12. Conventional deblinder brush 26 used in combination with air purging is used to remove debris 14 from the holes of drum 4.

During the operation of debarking apparatus 2, small round wood or barky wood chips 6 are introduced into drum 4 as drum 4 rotates, preferably, at 5 to 50 rpm. It is to be understood that drum 4 rotates on conventional riding rings 20 and trunnions 22 at an angle $\alpha$ of 0° to 45°, preferably, less than 10°. As chips 6 traverse downwardly along drum 4, non-metallic attrition means 10 interact with chips 6 in order to remove bark, dirt and other debris 14 from chips 6. Agitation area 8 agitates chips 6 and attrition means 10 so as to create a proper contact between attrition means 10 and chips 6 so that bark and other debris 14 can be removed from chips 6.

After chips 6 have interacted with attrition means 10, chips 6 are further traversed downwardly along drum 4 towards chip discharge areas 16 and 18. Preferably, chip discharge area 16 sends debarked chips to a conventional pulp mill while chip discharge area 18 sends larger chips 6 back to apparatus 24 for conditioning and apparatus 2 for further debarking.

It is to be understood that operators of apparatus 2 will need to modify the aggressiveness of the attrition-screening of apparatus 2 to match the wood species mix and predilection for preferential bark crushing. The operators may also need to adjust the operating conditions of apparatus 2 according to seasonal variations.

It has been further discovered that a conventional chip conditioner 24, preferably, a compression nip, can be used to fracture overthick barky chips 6 and begin bark breaking on smaller chips. In this manner, the bark located on chips 6 is fractured before entering the drum 2 and can be more easily removed within apparatus 2.

It is to be understood that the design of apparatus 2 can involve commercial, coaxial multi-concentric shells, that involve different hole sizes to sequentially segregate accept-size chips from pin chips, fines, etc. In this manner, attrition means 10 can be located in each coaxial shell section.

As further proof of the novelty of the present invention, the following test results are presented.

The following examples illustrate how bark and sand were removed from chips 6 by invention attrition-screening involving attrition means 10 and screening by holes 12. These data reveal that debris 14 removal was directly-related to weight of attrition means 10; therefore, it will be shown that wooden attrition means 10, which abrade fiber not metal, can adequately remove bark without adding contaminants.

EXAMPLE NO. 1

Whole-tree chips (WTC) 6 were rotated at 11 rpm with 9 ft long debarked logs 10, each weighing 30 lbs, inside a perforated-hole drum 4 of 2 ft diameter by 10 ft long. WTC 6 continuously entered the downward-inclined drum 2 and bark was crushed and removed as debris 14 by ¼"-holes 12 in the first 8 ft of drum 2. Debarked WTC 16, 18 continuously exited by 2-¾" size holes in the final 2 ft of drum 2 and was collected and analyzed for bark content.

The trial showed two important trends: (1) multiple chip impacts improved debarking, since passing the WTC first through a ¼"-gap nip "conditioner" 24 before drum 2 reduced absolute bark by 1%; and (2) bark level decreased proportional to the weight of attrition means 10 used, from 4.5% level in chips 6 down to 1% level in output 16, 18 when using nine wooden poles as attrition means 10.

EXAMPLE NO. 2

A 15" diameter by 23" long perforated batch drum 2 rotated WTC with a hardwood post attrition means 10. Chips 6 plus attrition means 10 were placed horizontally inside the drum screen 4 through an open port end. A motor transmitted rotation speed by a belted motor drive, and the drum screen had internal L-shaped "lifters" to help raise chips 6 and attrition means 10. During treatment, debris 14 fine materials fell through or were forced through drum screen holes 12 and were removed. At the end of the batch treatment periods, output chips 16, 18 were withdrawn from inside of the drum shell 4.

The method of the present invention reduced hardwood WTC bark level from 18% in chips 6 down to 6–8% in output 16, 18. Such bark reduction allows WTC to be blended with low-bark chips, for example, from drum-debarked roundwood, for successful pulping Attrition-screening resulted in a loss of 25% WTC debris 14 through 3/16"-perforations; however, debris 14 had at least 60% bark content, making it more suitable for fuel use than pulp and paper applications.

Sand analyses on output 16, 18 showed attrition-screening reduced sand level from 4.0–7.0 lb sand/O.D. ton for WTC 6 down to 0.8–2.0 lb sand/O.D. ton for output 16, 18. Drum screening alone, without attrition means 10, only reduced sand level to 2.1–2.3 lb sand/O.D. ton for output 16, 18.

EXAMPLE NO. 3

Employing drum 2 described in Example 2, bark removal from WTC 6 was compared for three optional attrition means 10, which were:

(1) Six hardwood rods, 22" long, 2.5–4" diameter, having total weight 33.7 lb or (2) Six empty schedule-40 1⅞" diameter plugged pipes, 21" long, of total weight 32.4 lb or (3) Six filled plugged schedule-40 1⅞" diameter pipes having total weight 82.2 lb.

Table 1 shows that material recovered as output 16, 18 was 92–95% when chip retention time in drum 2 was 10 minutes or when drum screening without attrition means 10 was done, whether for 10 or 50 minutes. However, attrition-screening on chips 6 for 50 minutes reduced output 16, 18 to 74–78% for chips 6. WTC loss was least for 10-minute drum screening without attrition (4.5%) and greatest for filled pipes as attrition means 10 for 50 minutes (27%).

When using essentially the same weight attrition means 10 for 50 minutes, 12.4% debris 14 were removed using 32.4 lb empty pipes, or 14.3% debris 14 using 33.7 lb hardwood rods. In contrast, for 82.2 lb filled pipes attrition, 27% debris 14 was removed. These results imply debris 14 removal is a function of attrition weight 10 used, rather than diameter or density; therefore, wood can substitute for metal as attrition means 10.

Table 1 also shows that as attrition reduced % output 16, 18 and increased % debris 14, the bark level in output 16, 18 fell correspondingly. Initial chip 6 bark level was 17.9%. Drum screening alone reduced it to 16–17% bark; modest attrition for 10 or 50 minutes by wooden posts or empty pipes reduced it to 13–14% bark; while filled pipe treatment for 50 minutes reduced bark level to 6–8% level. Table 1 additionally reveals that % bark level in the debris 14 samples remained at 60–70%, regardless of the intensity or period of attrition-screening, implying bark was preferentially crushed and screened through holes 12 of drum 2 into debris 14.

EXAMPLE NO. 4

Table 2 shows results for pine WTC 6 using drum 2 of Example 2 for attrition-screening. Drum-screening alone for 10 or 50 minutes with no attrition means 10 or 10-minute modest attrition by wooden rods 10 gave 85% output 16, 18 and 15% debris 14. As a result, drum-screening only or modest attrition for 10 minutes yielded debris 14 having 20–30% wood, 30–40% bark and 30–50% needles. In contrast, 50 minutes attrition with wooden rods or empty steel pipes resulted in 76% output 16, 18 and 24% debris 14; and the debris 14 had composition 30–40% wood, 40–60% bark and only 0–20% needles.

This trial confirmed that, for pine WTC using equal-weight attrition means 10, there were constant chip outputs 16, 18 (76%), amounts of debris 14 (24%); as well as similar bark levels (40–50%) and wood levels (33–36%) in debris 14.

EXAMPLE NO. 5

Table 3 shows for both hardwood and pine WTC using drum 2 of Example 2 that attrition-screening removed difficult-to-detach attached bark from chips 6.

For hardwood WTC, attached bark level was 2% in the chips 6 originally or after 50 minutes drum screening with no attrition means 10. Use of six wooden rods 10 or the same weight of empty steel pipes 10 reduced attached bark to 1%, and six heavy filled pipes resulted in only 0.02% attached bark in output 16, 18. Similarly for pine WTC, starting with 4% attached bark in chip feed 6, performing 50 minutes drum-screening only reduced bark to 3%. Equal-weight wooden rods or empty steel pipes reduced bark to 0.1–0.9%. Filled pipes reduced attached bark level to 0.1%.

EXAMPLE NO. 6

Table 4 shows how increasing intensiveness of attrition-screening, using drum 2 of Example 2: (a) improved size classification of output 16, 18, (b) lowered sand content of hardwood WTC output 16, 18, while (c) raising % sand content of debris 14. Attrition-screening accelerated sand removal from WTC because impacts on barky chips crushed sandy bark and dislodged sand ground into chips 6. Except for untreated control chips 6, which were not classified for size, each output 16, 18 and debris 14 sample was classified on a shaker screen to yield "Accepts," "Pin Chips" and "Fines."

It was discovered that, when very intense attrition was used, it was not necessary to classify chips for size because attrition-screening reduced "Oversize" materials to Accepts-size and removed debris 14 Pins and Fines. Therefore, essentially all output 16, 18 became Accept size. As a result, the more uniform-size output chips 16, 18 have significantly improved pulpability, resulting in better paper quality.

The final two columns in Table 4 list weight of sand measured in the output 16, 18 and in debris 14 and also calculate the lb sand/O.D. ton of chips. These data show:

(1) Untreated control chips 6 had 4–7 lb sand/O.D. ton chip 6 material (2) Modest attrition-screening (wooden rods or empty pipes), reduced sand in output 16, 18 accept-size chips to 2–4 lb sand/O.D. ton material (3) Intense attrition-screening (filled pipes and 50 rpm) reduced accept sand level to 0.8 lb/ton chip material, making output 16, 18 acceptable for pulping, and (4) In debris 14, Pin chip sand was 8–30 lb/ton, while debris 14 fines sand was 55–155 lb/ton. At these high sand levels, debris 14 is most suitable for fuel use.

Once given the above disclosure, many other features, modifications or improvements will become apparent to the skilled artisan. Such features, modifications or improvements are, therefore, considered to be a part of this invention, the scope of which is to be determined by the following claims.

TABLE 1

HARDWOOD WTC: Effect of Drum Retention Time and Attrition on Output, Debris and % Bark Levels
Variables: Attrition period (10 or 50 min.)
And type of attrition used (none, wood rods, empty pipes or filled pipes)

| Type of Attrition | | | Products From Drum | | % Bark Levels | |
|---|---|---|---|---|---|---|
| Time, min. | Number | Form | Output 16, 18, Wt. % | Debris 14, Wt. % | % Bark in Output 16, 18 | % Bark in Total Debris 14 |
| 10 | none | drum screen | 95.5 | 4.5 | 17.6 | 67.2 |
| 10 | 6 wood | control rods | 95.4 | 4.6 | 14.3 | 62.3 |
| 10 | 6 filled | pipes | 92.2 | 7.8 | 15.6 | 62.3 |
| 50 | none | drum screen | 92.5 | 7.5 | 16.5 | 64.2 |
| 50 | 6 wood | control rods | 87.6 | 12.4 | 13.7 | 71.3 |
| 50 | 6 empty | pipes | 85.7 | 14.3 | 13.5 | 66.0 |
| 50 | 6 filled Trial #1 | pipes | 72.7 | 27.3 | 8.4 | 67.7 |
| 50 | 6 filled Trial #2 | pipes | 73.5 | 26.5 | 6.2 | 59.8 |

TABLE 2

PINE WTC: Effect of Retention and Attrition on % Output, % Debris, and % Needles and Bark in Debris

| Sample Retention Time, min. | Description Attrition Means | Drum Output 16, 18, Wt. % | Products Debris 14, Wt. % | Debris 14 Needles, Wt. % | Compostition Bark, Wt. % | Wood, Wt. % |
|---|---|---|---|---|---|---|
| 10 minutes | None--Drum Screen Control | 85.91 | 14.09 | 35.69 | 43.96 | 20.35 |
| 10 minutes | 6 wooden rods | 86.47 | 13.53 | 49.44 | 31.58 | 18.99 |
| 50 minutes | None--Drum Screen Control | 86.83 | 13.17 | 38.55 | 27.57 | 33.88 |
| 50 minutes | 6 wooden rods | 75.72 | 24.28 | 16.38 | 5O.43 | 33.19 |
| 50 minutes | 6 empty steel pipes | 75.58 | 24.42 | 23.40 | 40.13 | 36.48 |
| 50 minutes | 6 filled steel pipes | 64.00 | 36.00 | 0.00 | 60.26 | 39.74 |

TABLE 3

Ability of Attrition-Screening to Remove Attached Bark from Hardwood WTC and Pine WTC

| No. Minutes of Chip Retention in "Mixer" Drum | SAMPLE DESCRIPTION | % ATTACHED BARK IN HARDWOOD WTC | % ATTACHED BARK IN PINE WTC |
|---|---|---|---|
| None | FEED WTC--Untreated or "As is" Control | 1.79% | 3.94% |
| 10 minutes | 6 Filled Steel Pipes Attrition | 1.12% | 3.10% |
| 50 minutes | "Drum Screening Only" Control | 2.28% | 3.10% |
| 50 minutes | 6 Wooden Rods Attrition | 1.11% | 0.10% |
| 50 minutes | 6 Empty Steel Pipes Attrition | 1.00% | 0.88% |
| 50 minutes | 6 Filled Steel Pipes Attrition | 0.02% | 0.10% |

TABLE 4

Sand Content of Hardwood WTC Output and Debris from the Attrition-Screening Drum (Note: Samples also showing visible clay after ashing were indicated by asterisks in "Classification" column)

| Time, Min. | Attrition Used | % Debris | Sample | Classification Size & Clay (Clay =*) | Sand Wt., GRAMS | Lb Sand/ O.D. ton material |
|---|---|---|---|---|---|---|
| 0 | None | None | Control 1 | unclassified | 1.5006 | 3.947 |
| | | | Control 3 | unclassified* | 2.6708 | 6.827 |
| | | | Control 4 | unclassified* | 2.3231 | 5.808 |
| 10 | Drum screen | 4.5% | Outputs 16, 18 | Accepts* | 0.6655 | 2.152 |
| | | | Debris 14 | Pins* | 0.5513 | 26.877 |
| | | | | Fines* | 3.8657 | 118.863 |
| | Filled steel pipes | 7.8% | Outputs 16, 18 | Accepts | 0.5312 | 1.941 |
| | | | Debris 14 | Pins | 0.5617 | 20.356 |
| | | | | Fines* | 6.1257 | 90.865 |
| 50 | Drum screen | 7.5% | Outputs 16, 18 | Accepts* | 0.5747 | 2.305 |
| | | | Debris 14 | Pins* | 1.112 | 28.474 |
| | | | | Fines* | 7.3451 | 122.872 |
| | Filled steel pipes | 26.5% | Outputs 16, 18 | Unclassified | 0.2148 | 0.820 |
| | | | Debris 14 | Pins* | 1.0491 | 7.524 |
| | | | | Fines* | 12.8174 | 55.655 |

TABLE 5

Effect of Drum RPM on Attrition-Screening of pine WTC

| Trial Condition | % Reduction in Level after removing all Pins & Fines | |
|---|---|---|
| Drum RPM | % Bark Reduction | % Needles Reduction |
| Untreated feed--control | 17.60% | 55.12% |
| 25 RPM | 24.75% | 92.95% |
| 37.5 RPM | 14.41% | 88.93% |
| 50 RPM | 33.72% | 84.78% |

TABLE 6

Effect of Attrition Means Volume/Chip Volume for Pine WTC at 25 RPM

| Experimental Conditions Used | | Results--% Reduction by removing all pins & fines | | |
|---|---|---|---|---|
| Gal. Chips added to 4.68 gal. Posts | Attrition Volume/Chip Volume | Classified % Pins & Fines | % Bark Reduction | % Needles Reduction |
| Untreated | No attrition | 11.61% | 17.60% | 55.12% |
| 4 gal., no posts | Screening only | 9.67% | 20.28% | 66.15% |
| 6 gallon | 4.68/6 = 0.78 | 10.33% | 10.49% | 76.83% |
| 4 gallon | 4.68/4 = 1.17 | 13.99% | 24.75% | 92.95% |
| 2 gallon | 4.68/2 = 2.34 | 15.80% | 20.66% | 95.38% |
| 1 gallon | 4.68/1 = 4.68 | 22.10% | 54.09% | 92.06% |

We claim:

1. An apparatus for wood debarking, wherein said apparatus is comprised of:

a substantially cylindrical debarking drum having an inside and an outside, a barky wood inlet means, a debarked wood outlet means and a length, wherein said drum is inclined at a predetermined angle such that said inlet means is raised above said outlet means;

a barky wood and attrition means agitating means located along said length and said inside of said drum;

a debarked wood screening means located along said length and substantially between said inside and outside of said drum;

a non-metallic attrition means located within said drum; and a drum rotating means operatively connected to said outside of said drum.

2. The apparatus, as in claim 1, wherein said drum is constructed of:

a metallic material.

3. The apparatus, as in claim 1, wherein said screening means is further comprised of:

a holes.

4. The apparatus, as in claim 1, wherein said drum rotating means is further comprised of:

a riding ring means rigidly attached to said outside of said drum; and a driving means.

5. The apparatus, as in claim 4, wherein said driving means is further comprised of:

trunnions.

6. The apparatus, as in claim 1, wherein said apparatus is further comprised of:

a chip conditioning means operatively connected to said inlet means.

7. The apparatus, as in claim 6, wherein said conditioning means is further comprised of:

a nip.

8. The apparatus, as in claim 1, wherein said barky wood is further comprised of:

barky chips.

9. The apparatus, as in claim 1, wherein said barky wood is further comprised of:

roundwood.

10. The apparatus, as in claim 1, wherein said apparatus is further comprised of:

a bark debris removal means.

11. The apparatus, as in claim 10, wherein said debris removal means is further comprised of:

a brush.

12. A method of debarking wood, wherein said method is comprised of the steps of:

introducing barky wood into a substantially cylindrical debarking drum having an inside and an outside, a barky wood inlet means, a debarked wood outlet means and a length, wherein said drum is inclined at a predetermined angle such that said inlet means is raised above said outlet means; a barky wood agitating means located along said length and said inside of said drum; a debarked wood screening means located along said length and substantially between said inside and outside of said drum; a non-metallic attrition means located within said drum; and a drum rotating means operatively connected to said outside of said drum;

interacting said barky wood with said agitating means and said attrition means to remove substantially all bark from said barky wood;

traversing said debarked wood from said drum; and removing said bark from said debarked wood.

13. The method, as in claim 12, wherein said method is further comprised of the step of:

conditioning said barky wood before said barky wood is introduced into said drum.

* * * * *